US008845063B2

(12) United States Patent
Sano

(10) Patent No.: US 8,845,063 B2
(45) **Date of Patent: *Sep. 30, 2014**

(54) PRINTING APPARATUS AND PRINTING METHOD

(71) Applicant: Seiko Epson Corporation, Tokyo (JP)

(72) Inventor: Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,090

(22) Filed: Jul. 10, 2013

(65) Prior Publication Data

US 2013/0300792 A1 Nov. 14, 2013

Related U.S. Application Data

(63) Continuation of application No. 13/198,494, filed on Aug. 4, 2011, now Pat. No. 8,506,048.

(30) Foreign Application Priority Data

Aug. 5, 2010 (JP) ..... 2010-176003

(51) Int. Cl.
*B41J 2/205* (2006.01)

(52) U.S. Cl.
USPC ..... 347/15; 347/41

(58) Field of Classification Search
USPC ..... 347/12, 15, 40, 43, 41
See application file for complete search history.

(56) References Cited

U.S. PATENT DOCUMENTS

| | | | | |
|---|---|---|---|---|
| 7,407,277 | B2 | 8/2008 | Yoneyama | |
| 7,453,600 | B1 * | 11/2008 | Walton et al. | 358/1.9 |
| 7,503,641 | B2 | 3/2009 | Nino | |
| 7,591,532 | B2 | 9/2009 | Kanda et al. | |
| 7,654,630 | B2 | 2/2010 | Marra, III et al. | |
| 8,016,385 | B2 * | 9/2011 | Kiuchi et al. | 347/41 |
| 8,506,048 | B2 * | 8/2013 | Sano | 347/43 |
| 8,540,336 | B2 * | 9/2013 | Kurata et al. | 347/19 |
| 2009/0322814 | A1 | 12/2009 | Sano | |
| 2010/0053247 | A1 | 3/2010 | Kakutani | |

FOREIGN PATENT DOCUMENTS

| | | | |
|---|---|---|---|
| JP | 2003-285422 | A | 10/2003 |
| JP | 2010-005878 | | 1/2010 |
| JP | 2010-052228 | A | 3/2010 |

* cited by examiner

*Primary Examiner* — Lamson Nguyen
(74) *Attorney, Agent, or Firm* — Maschoff Brennan

(57) ABSTRACT

A control section is included which performs a background image pre-printing which enables each ink to be ejected from the upstream side background color nozzle row and the downstream side color nozzle row and can land the color ink after landing the background color ink on the medium in a region concerning the transport direction, and a background image post-printing which enables each ink to be ejected from the upstream side color nozzle row and the downstream side background color nozzle row and can land the background color ink after landing the color ink on the medium in a region concerning the transport direction, the control section performing the printing so as to switch over the background image pre-printing and the background image post-printing on one medium.

7 Claims, 8 Drawing Sheets

PRINTING APPARATUS AND PRINTING METHOD

RELATED APPLICATION

This patent application is a continuation of U.S. patent application Ser. No. 13/198,494, filed Aug. 4, 2011, which is incorporated herein by reference.

BACKGROUND

1. Technical Field

The present invention relates to a printing apparatus and a printing method.

2. Related Art

Ink jet printers are being developed which move a head for ejecting ink to perform printing. Among such printers, for example, there is a printer which can eject a white ink to form a background image and can eject a color ink to form a color image (see, JP-A-2010-5878).

Among printing regions, there are a region (a background image pre-printing region) where the background image is firstly formed and then the color image is formed, and a region (a background image post-printing region) where the color image is firstly formed and then the background image is formed. In that case, it is desirable to perform the printing so as to suitably switch over the printing of the background image pre-printing region and the printing of the background image post-printing.

SUMMARY

An advantage of some aspects of the invention is to perform printing so as to switch over printing of a so-called background image pre-printing region and background image post-printing region.

According to an aspect of the invention, there is provided a printing apparatus which includes: (A) a transport portion that transports a medium in a transport direction; (B) an upstream side background color nozzle row in which nozzles for ejecting a background color ink to the medium are aligned along the transport direction; (C) an upstream side color nozzle row in which nozzles for ejecting a color ink to the medium are aligned along the transport direction; (D) a downstream side background color nozzle row that is disposed in the downstream side further than the upstream side background color nozzle row concerning the transport direction; (E) a downstream side color nozzle row in which nozzles for ejecting the color ink to the medium are aligned along the transport direction; (F) a moving section that moves the upstream side background color nozzle row, the upstream side color nozzle row, the downstream side background color nozzle row, and the downstream side color nozzle row in a intersection direction intersecting the transport direction; and (G) a control section that performs a background image pre-printing which enables each ink to be ejected from the upstream side background color nozzle row and the downstream side color nozzle row and can land the color ink after landing the background color ink on the medium in a region concerning the transport direction, and a background image post-printing which enables each ink to be ejected from the upstream side color nozzle row and the downstream side background color nozzle row and can land the background color ink after landing the color ink on the medium in a region concerning the transport direction, the control section performing the printing so as to switch over the background image pre-printing and the background image post-printing on the one medium.

Other characteristics of the invention will be apparent from the present description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
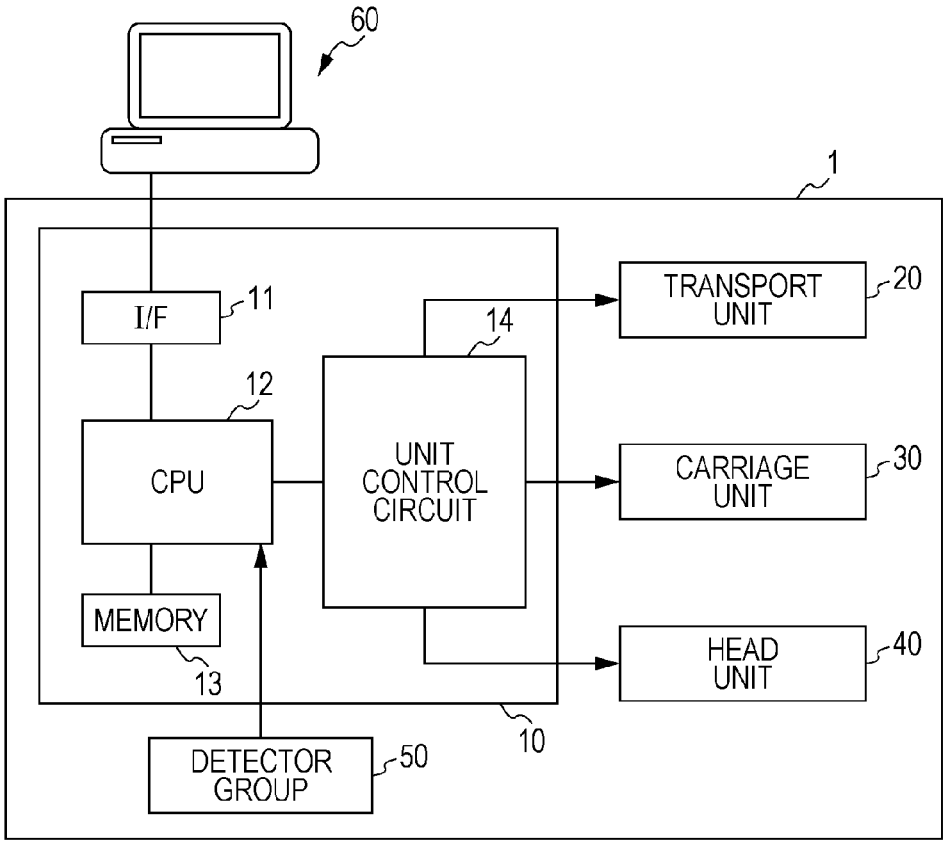
FIG. 1 is an overall configuration block diagram of a printer.

At least the followings become clear by the descriptions of the present specification and the accompanying drawings.

A printing apparatus includes: (A) a transport portion that transports a medium in a transport direction; (B) an upstream side background color nozzle row in which nozzles for ejecting a background color ink to the medium are aligned along the transport direction; (C) an upstream side color nozzle row in which nozzles for ejecting a color ink to the medium are aligned along the transport direction; (D) a downstream side background color nozzle row that is disposed in the downstream side further than the upstream side background color nozzle row concerning the transport direction; (E) a downstream side color nozzle row in which nozzles for ejecting the color ink to the medium are aligned along the transport direction; (F) a moving section that moves the upstream side background color nozzle row, the upstream side color nozzle row, the downstream side background color nozzle row, and the downstream side color nozzle row in a intersection direction intersecting the transport direction; and (G) a control section that performs a background image pre-printing which enables each ink to be ejected from the upstream side background color nozzle row and the downstream side color nozzle row and can land the color ink after landing the background color ink on the medium in a region concerning the transport direction, and a background image post-printing which enables each ink to be ejected from the upstream side color nozzle row and the downstream side background color nozzle row and can land the background color ink after landing the color ink on the medium in a region concerning the transport direction, the control section performing the printing so as to switch over the background image pre-printing and the background image post-printing on the one medium.

In this manner, it is possible to perform the printing so as to suitably switch over the printing of a so-called background image pre-printing region and background image post-printing region.

In the printing apparatus, it is preferable that the printing of a single region which forms any one of the background image and the color image is performed between the background image pre-printing and the background image post-printing.

In this manner, it is possible to switch over the background image pre-printing and the background image post-printing including the printing of the single region.

Furthermore, it is preferable that the upstream side background color nozzle row, the downstream side background color nozzle row, the upstream side color nozzle row, and the downstream side color nozzle row are integrally moved in the intersection direction.

In this manner, each nozzle can be mounted on one head.

Furthermore, it is preferable that ink is ejected in any one direction of the forward direction and a return direction during movement of the intersection direction.

In this manner, it is possible to suitably perform the background image pre-printing and the background image post-printing.

Furthermore, it is preferable that the background color ink is a white ink.

In this manner, it is possible to form a background image in which white is used as a base.

Furthermore, the background color ink may be ink of a metallic tone.

In this manner, it is possible to form a background image in which the metallic is used as a base.

Furthermore, it is preferable that the control section performs the toning of the background image by the use of the upstream side color nozzle row in the background image pre-printing and performs the toning of the background image by the use of the downstream side color nozzle row in the background image post-printing.

In this manner, it is possible to suitably tone the background image in both of the background image pre-printing and the background image post-printing.

A printing method in a printing apparatus which includes (A) a transport portion that transports a medium in a transport direction; (B) an upstream side background color nozzle row in which nozzles for ejecting a background color ink to the medium are aligned along the transport direction; (C) an upstream side color nozzle row in which nozzles for ejecting a color ink to the medium are aligned along the transport direction; (D) a downstream side background color nozzle row that is disposed in the downstream side further than the upstream side background color nozzle row concerning the transport direction; (E) a downstream side color nozzle row in which nozzles for ejecting the color ink to the medium are aligned along the transport direction; (F) a moving section that moves the upstream side background color nozzle row, the upstream side color nozzle row, the downstream side background color nozzle row, and the downstream side color nozzle row in a intersection direction intersecting the transport direction; and (G) a control section that performs a background image pre-printing which enables each ink to be ejected from the upstream side background color nozzle row and the downstream side color nozzle row and can land the color ink after landing the background color ink on the medium in a region concerning the transport direction, and a background image post-printing which enables each ink to be ejected from the upstream side color nozzle row and the downstream side background color nozzle row and can land the background color ink after landing the color ink on the medium in a region concerning the transport direction, the method including discriminating the background image pre-printing and the background image post-printing in the medium; printing so as to switch over the background image pre-printing and the background image post-printing based on the discrimination result.

In this manner, it is possible to suitably perform the printing so as to switch over printing of a so-called background image pre-printing region and background image post-printing region.

EMBODIMENT

Hereinafter, a printing system will be described as an example in which a printing apparatus is an ink jet printer (hereinafter, a printer), and the printer is connected to a computer.

Figure 2:
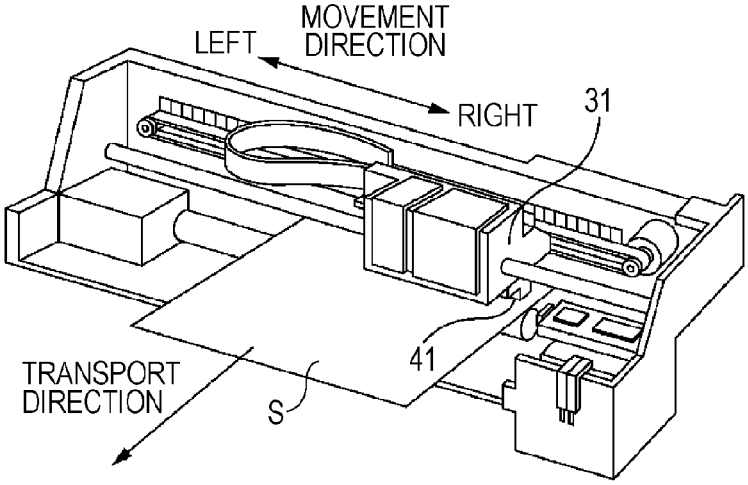
FIG. 2 is a perspective view of the printer.

FIG. 1 is an overall configuration block diagram of a printer 1. FIG. 2 is a perspective view of the printer 1. A computer 60 is connected to the printer 1 in a communicable manner and outputs printing data for printing an image in the printer 1 to the printer 1. In addition, in the computer 60, a program (a printer driver) for converting image data output from an application program into printing data is installed. The printer driver is recorded on a recording medium (a recording medium that is readable by the computer) such as a CD-ROM or is able to be downloaded to the computer via the internet.

A controller 10 is a control unit for performing the control of the printer 1. An interface portion 11 performs the transmission and reception of data between the computer 60 and the printer 1. The CPU 12 is a calculation processing apparatus for controlling the entire printer 1. The memory 13 secures a region for storing the program of a CPU 12, a working region or the like. The CPU 12 controls each unit by a unit control circuit 14. In addition, a detector group 50 monitors the situation in the printer 1 and the controller 10 controls each unit based on the detection result.

A transport unit 20 sends a medium S to a recordable position, and transports the medium S in a transport direction by a predetermined transport amount during printing.

A carriage unit 30 moves a head 41 in a movement direction intersecting the transport direction, and has carriage 31.

A head unit 40 ejects ink onto the medium S and has the head 41. The head 41 is moved in the movement direction by the carriage 31 of the carriage unit 30. A plurality of nozzles as an ink ejecting section is provided on the lower surface of the head 41, and an ink chamber (not shown) containing ink is provided in each nozzle.

Figure 3:
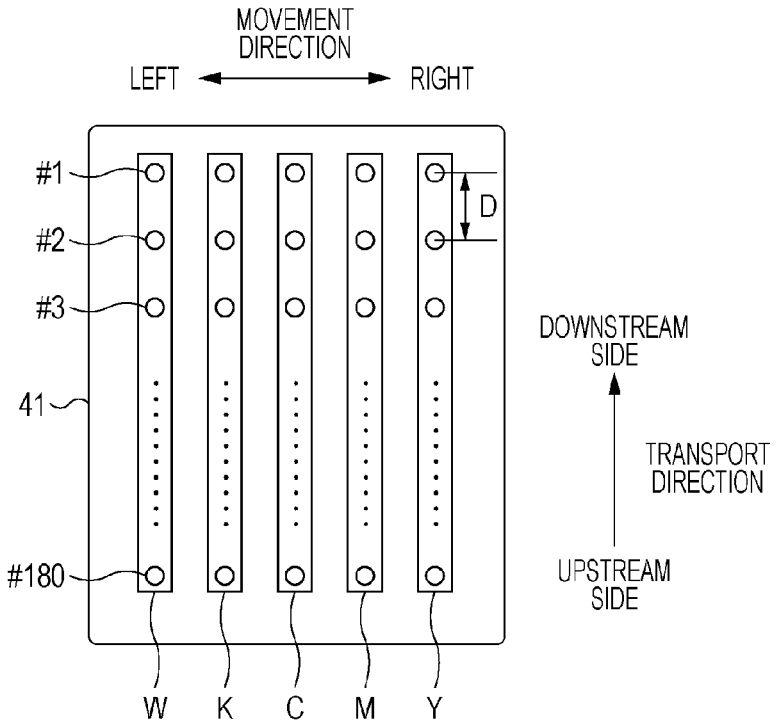
FIG. 3 is a diagram that shows an arrangement of nozzles that are provided in a lower surface of a head.

FIG. 3 is a diagram that shows an arrangement of the nozzles provided on the lower surface of the head 41. In addition, FIG. 3 is a diagram of the nozzles which is virtually viewed from the upper surface of the head 41. On the lower surface of the head 41, five rows of nozzle rows are formed in which 180 nozzles are aligned in the transport direction at a predetermined gap (a nozzle pitch D). As shown, a white nozzle row W ejecting white ink, a black nozzle row K ejecting black ink, a cyan nozzle row C ejecting cyan ink, a magenta nozzle row M ejecting magenta ink, and yellow nozzle row Y ejecting yellow ink are aligned in the movement direction. In addition, 180 nozzles of each nozzle row are sequentially denoted by small numbers from the nozzle of the downstream side in the transport direction (#1 to #180).

In such a printer 1, a dot forming processing of intermittently ejecting the ink droplet from the head 41 moved along the movement direction to form dots on the medium, and a transportation processing of transporting the medium with respect to the head 41 in the transport direction are repeated.

In this manner, it is possible to form the dots in the latter dot formation processing in a position of the medium different from the position of the dots formed by the former dot formation processing to print a two-dimensional image on the medium. In addition, an operation (one dot formation processing and ejection operation) in which the head 41 is moved in the movement direction once while ejecting the ink droplet is referred to as "pass".

Figure 4:
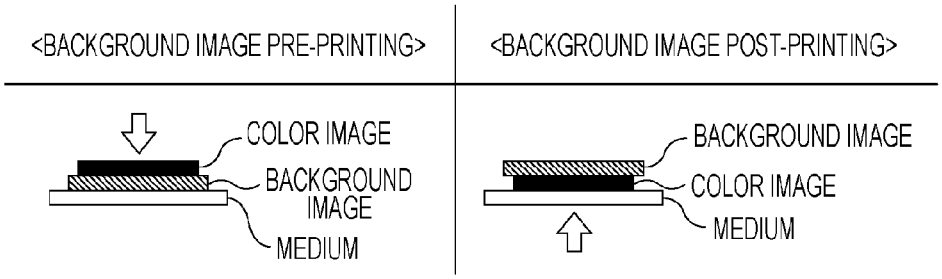
FIG. 4 is a diagram that describes a printing mode in the present embodiment.

FIG. 4 is a diagram that shows a print mode in the present embodiment. The printer 1 can perform "a background image pre-printing" which prints the color image so as to be seen from the printing surface side, and "a background image post-printing" which prints the color image so as to be seen from the medium side (a side opposite to the image forming side).

When performing the background image pre-printing, after the background color ink is firstly landed on the medium, the color ink is landed on the background color ink. Meanwhile, when performing the background image post-printing, after the color ink is firstly landed on the medium, the background color ink is landed on the color ink.

In the present embodiment, the nozzles in the head 41 are used as described below such that the background image pre-printing and the background image post-printing can be performed so as to be switched over on the one medium (hereinafter, referred to as "a switching printing").

First Switching Pattern

Figure 5A:
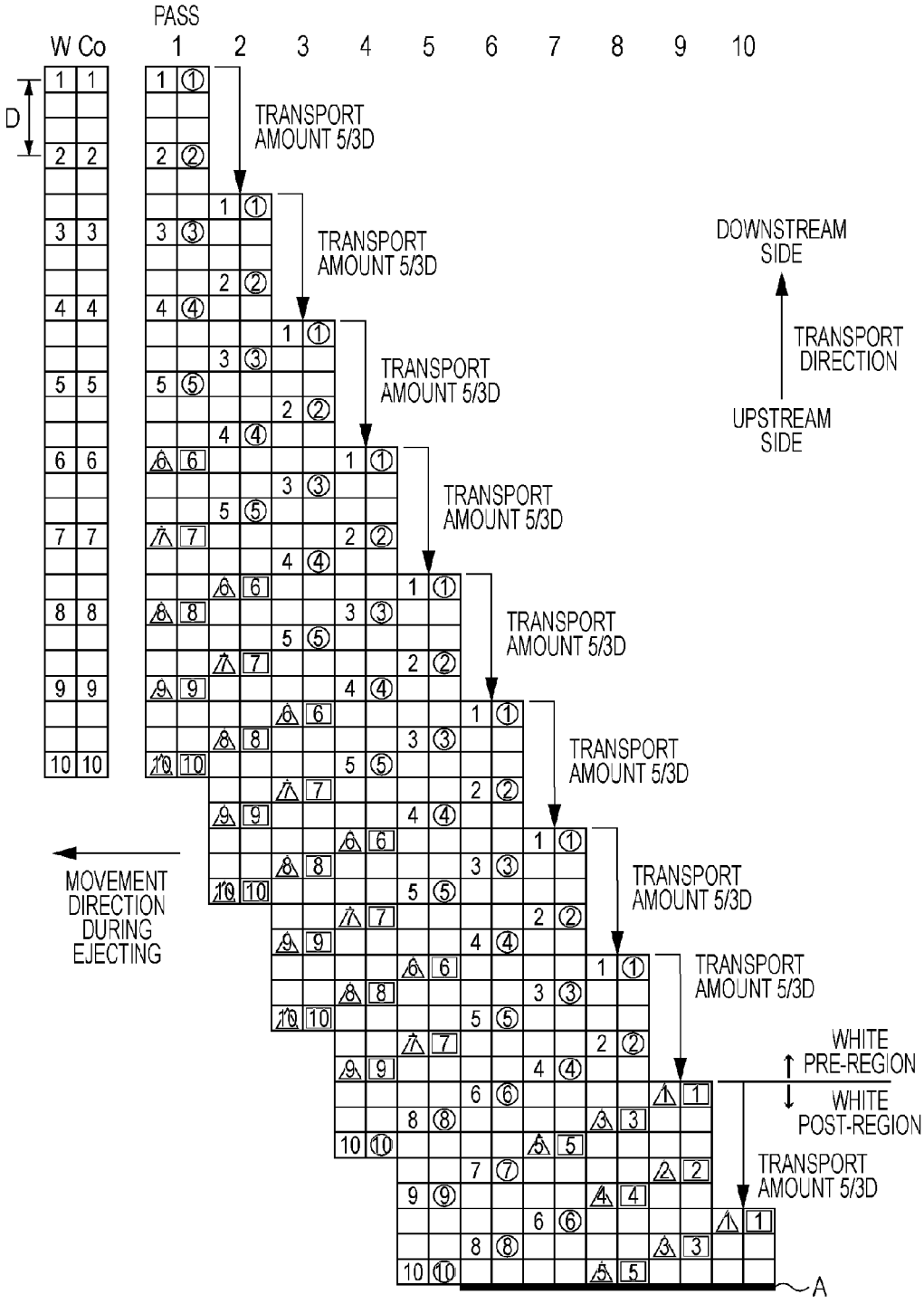
FIG. 5A is a first explanatory diagram of a first switching pattern.
Figure 5B:
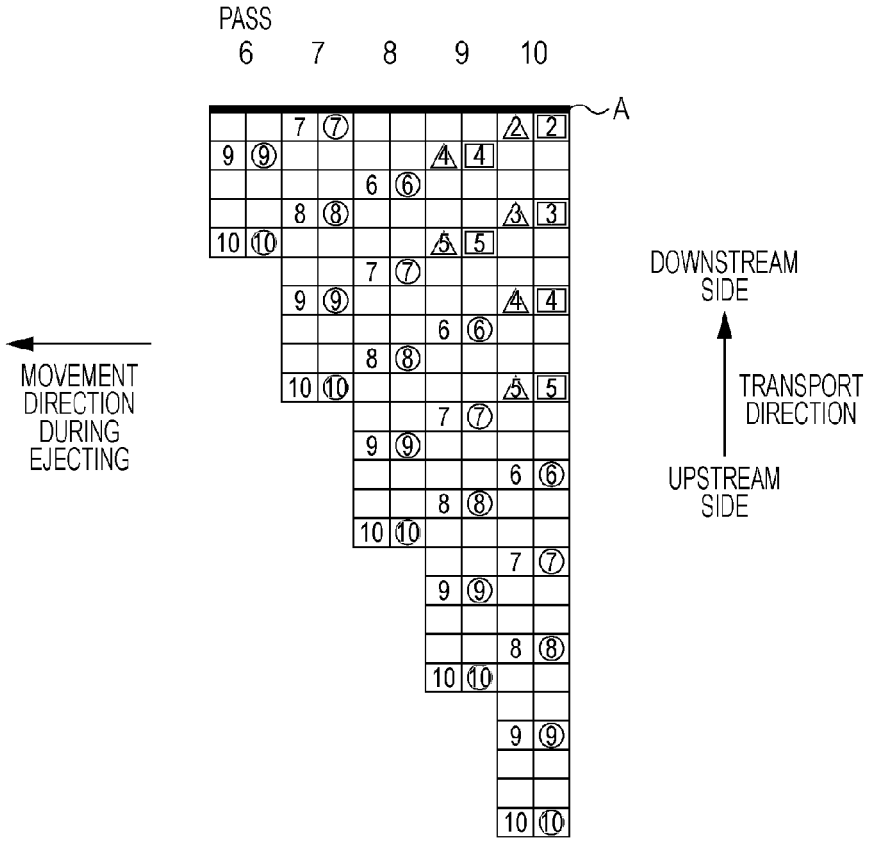
FIG. 5B is a second explanatory diagram of a first switching pattern.

FIG. 5A is a first explanatory diagram of a first switching pattern and FIG. 5B is a second explanatory diagram of the first switching pattern. Originally, the explanatory diagrams of the switching pattern shown in FIGS. 5A and 5B are one drawing but are divided into two drawings due to space limitation. FIGS. 5A and 5B are joined to each other in a portion of a thick line of reference numeral A shown in each diagram. By referring to both drawings in this way, an overall diagram of the first switching pattern is completed.

FIGS. 5A and 5B show a head of the nozzle pitch D. Furthermore, in the diagrams, for the simplicity of the description, the number of nozzles belonging to one nozzle row is drawn to be reduced to 10. Furthermore, the nozzle row each ejecting four color inks (YMCK) is collectively shown by "a color nozzle row Co". In addition, in the diagrams, the transport direction of the medium is shown and the relative transport amount of the head relative to the medium is shown. Furthermore, the movement direction (movement direction during ejecting) of the head when ejecting the ink is a direction that faces from a right side of the space to a left side thereof.

Furthermore, each pass is shown and the nozzle numbers used for each pass are surrounded by a circle, a triangle, and a square. The meaning of the written symbol is as follows:

Circle: nozzles that form the color image,

Triangle: nozzles that form the background image,

Square: nozzles that is used in the toning in some cases, (the toning is described later).

Furthermore, when the toning is not performed, ink is not ejected from the nozzles to which the symbol of square is added.

By performing the printing according to such a condition, in this manner, in the printing of a white former region (this is referred to because white as the background color is formed prior to the color image and corresponds to the background image pre-printing), the color image is formed by the use of the color nozzle rows (nozzles #1 to #5) of the downstream side while forming the background image by the use of the white nozzle rows (nozzles #6 to #10) of the upstream side.

Furthermore, in the printing of a white latter region (this is referred to in this manner because white as the background color is formed later than the color image and corresponds to the background image post-printing), the background image is used by the use of the white nozzle rows (nozzles #1 to #5) of the downstream side while forming the color image by the use of the white nozzle rows (nozzles #6 to #10) of the upstream side.

In this manner, by performing the printing as shown in the first switching pattern, it is possible to perform the printing so as to switched over from the printing of the white former region to the printing of the white latter region.

Toning

When the background image is printed using only the white ink, the color itself of the white ink printing the background image becomes the color of the background image. However, similarly, ink referred to as the white ink also slightly differs in color of white depending on the material or the like of ink. For that reason, in some cases, by the white ink to be used, the background image of color different from the color desired by a user is printed. Furthermore, depending on the printed matter, the background image having a slight chromatic color but not the simple white is also desired. Furthermore, in the case of using the white medium, even in the white medium, the color of white slightly differs depending on the kind of medium. For that reason, upon printing the background image on the white medium, when the white of the background image is different from the white of the medium, the background image stands out.

Thus, it is also possible to print the background image (the background image of the adjusted white) of a desired white by suitably using a small quantity of color inks (YMCK) together with the white ink. For example, in the embodiment shown in FIGS. 5A and 5B, as described above, a small quantity of ink is ejected from the nozzles of the number surrounded by the square reference numeral. In this manner, when printing the background image by the white ink and the color ink and the white ink has some color, it is possible to make the background image approach an achromatic color by printing the background image together with ink which negates the color.

Second Switching Pattern

In the first switching pattern mentioned above, the transition from the white former region to the white latter region is consecutively performed. However, the switching method is not limited thereto. For example, as described below, the single region may be provided behind the white former region, and then the white latter region may be provided. Herein, the single region is a region where only the color image or only the background image is formed.

Figure 6A:
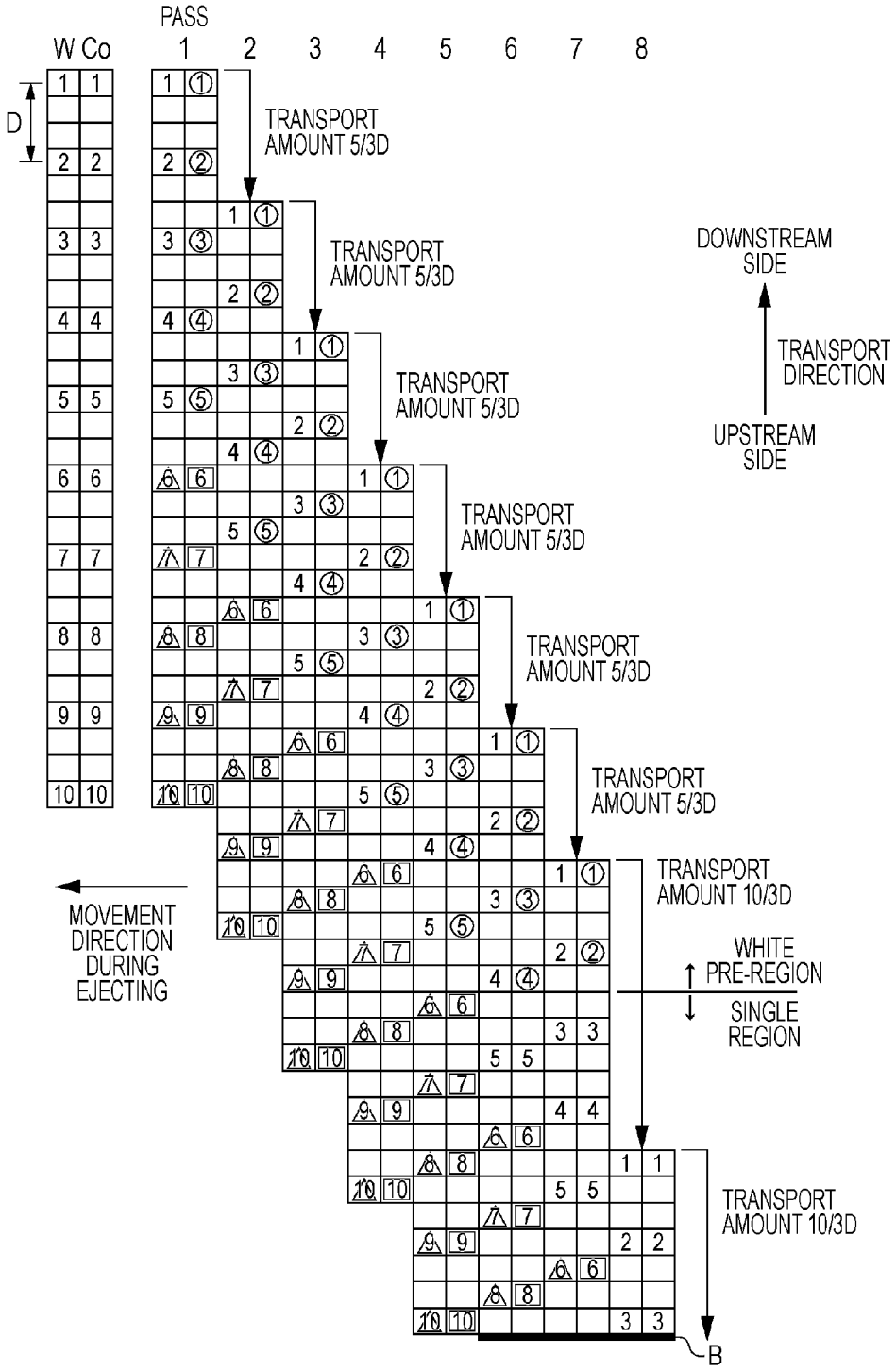
FIG. 6A is a first explanatory diagram of a second switching pattern.
Figure 6B:
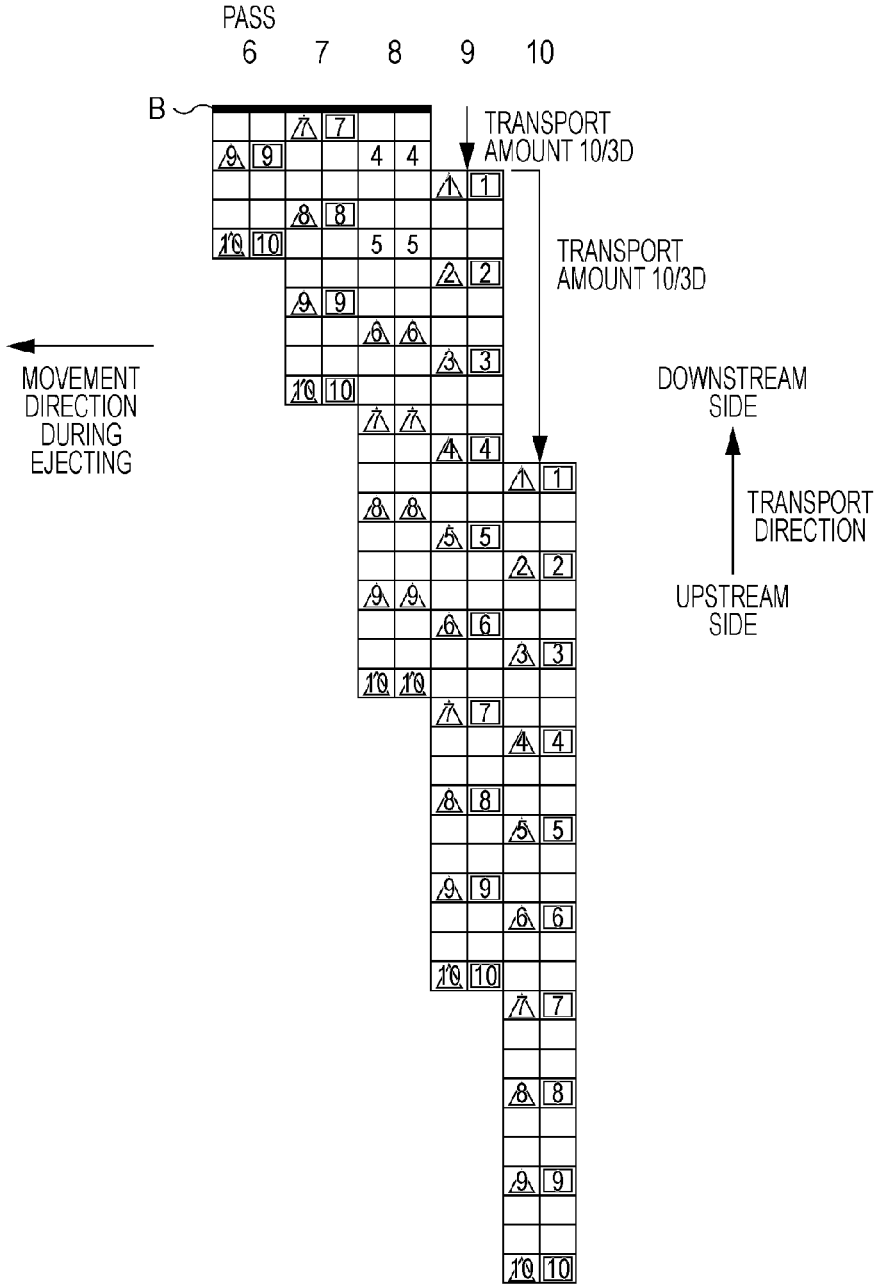
FIG. 6B is a second explanatory diagram of a second switching pattern.

FIG. 6A is a first explanatory diagram of a switching pattern 2. FIG. 6B is a second explanatory diagram of the switching pattern 2. FIGS. 6A and 6B were originally one drawing but are divided into two drawings due to space limitation. FIGS. 6A and 6B are joined to each other in a thick line portion of reference numeral B shown, respectively. In this manner, by referring to both drawings, an overall diagram of the switching pattern 2 (the first thereof) is completed. Furthermore the overall diagram of the switching pattern 2(the first thereof) shows the pattern that is switched over from the white former region to the single region.

Figure 7A:
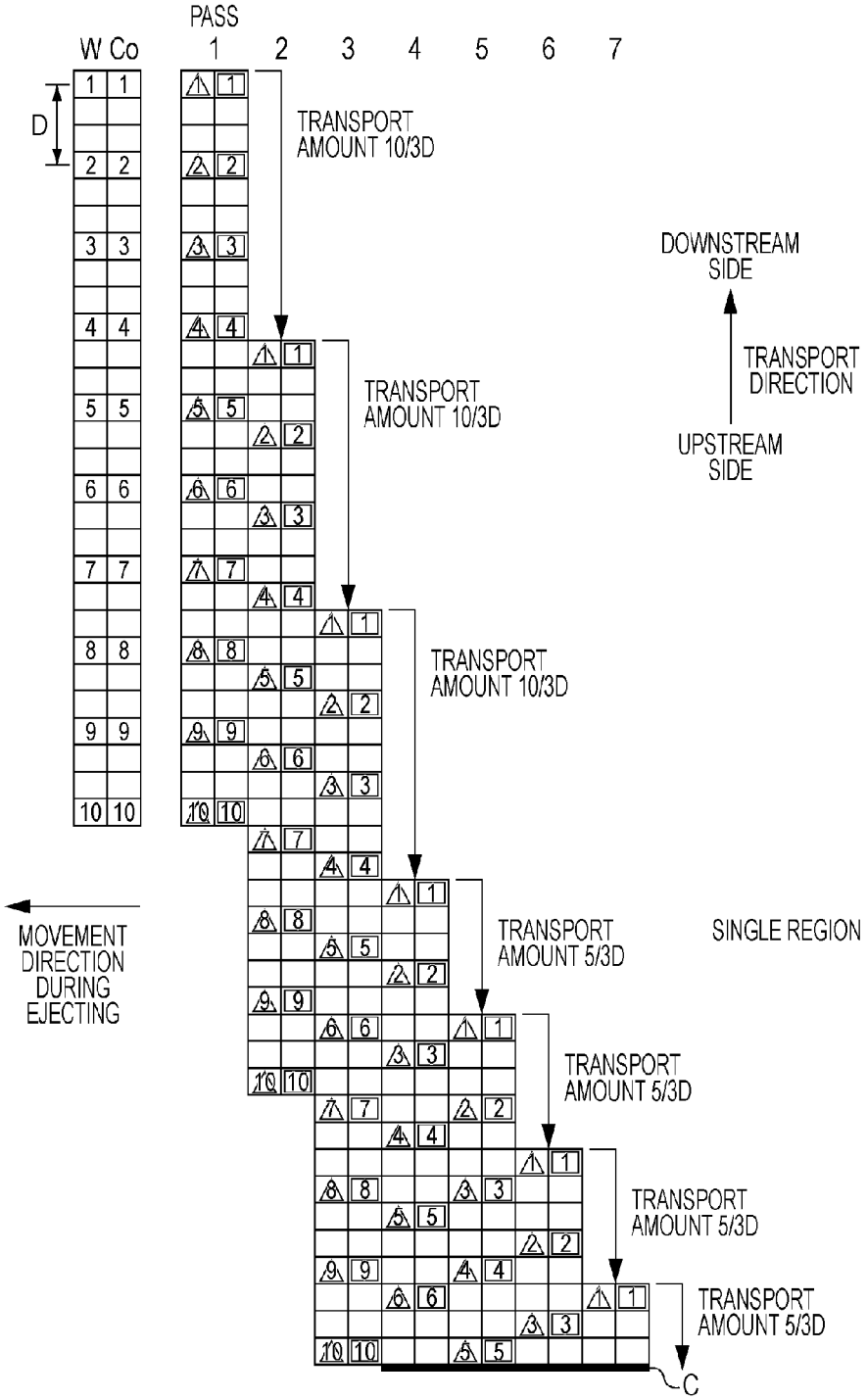
FIG. 7A is a third explanatory diagram of a second switching pattern.
Figure 7B:
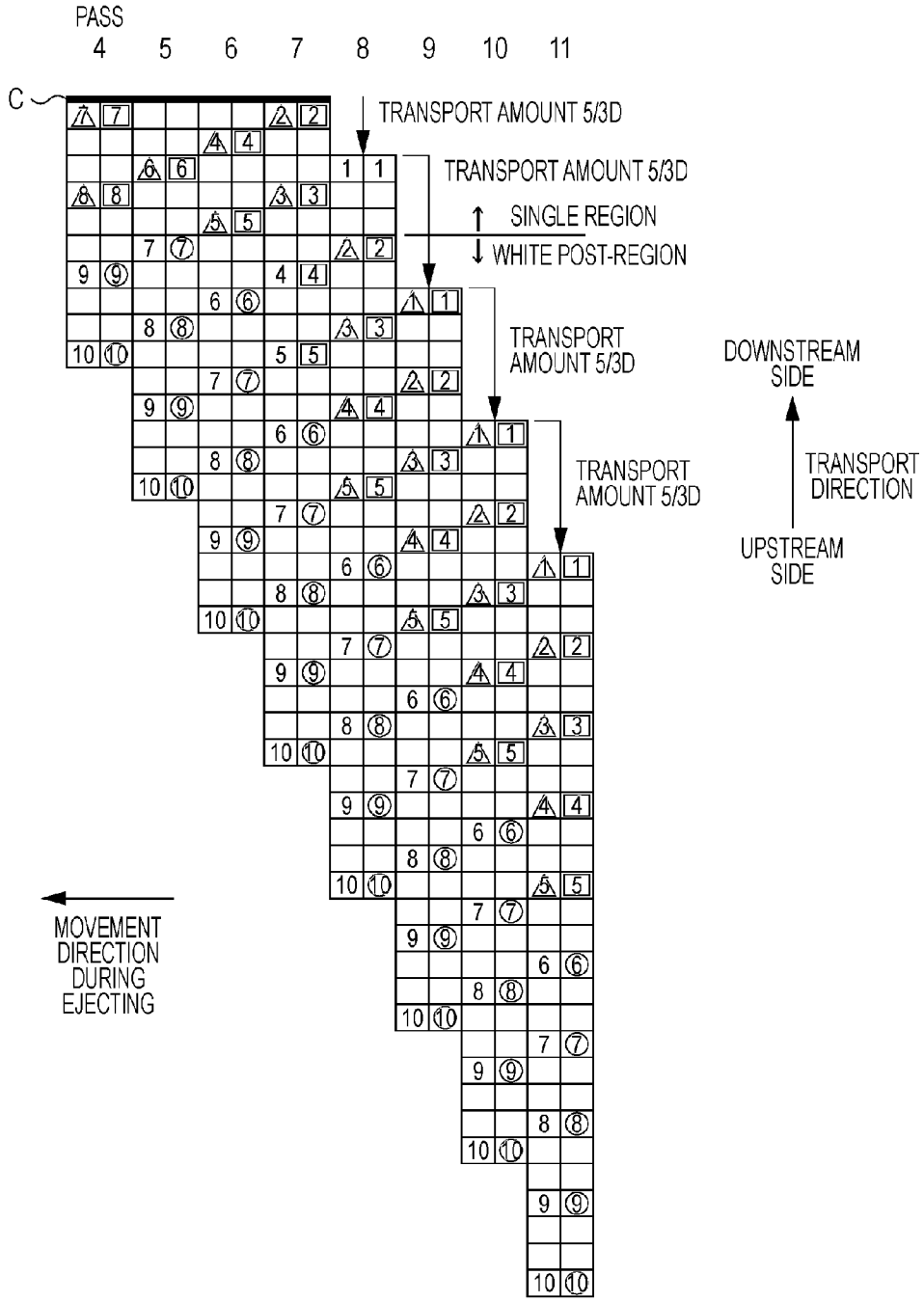
FIG. 7B is a fourth explanatory diagram of a second switching pattern.

Furthermore, FIG. 7A is a third explanatory diagram of the switching pattern 2, and FIG. 7B is a fourth explanatory diagram of the switching pattern 2. FIGS. 7A and 7B are originally one drawing but are divided into two drawings due to space limitation. FIGS. 7A and 7B are joined to each other in a thick line portion of reference numeral C shown, respectively. In this manner, by referring to both drawings, an overall diagram of the switching pattern 2 (the second thereof) is completed. Furthermore the overall diagram of the switching pattern 2 (the second thereof) shows the pattern that is switched over from the single region to the white latter region.

Herein, for the simplicity of the description, the number of nozzles belonging to the nozzle row 1 is drawn to be reduced to 10. In addition, each pass is shown and the nozzle numbers used for each pass are surrounded by a circle, a triangle, and a square. The meaning of the written symbol is as follows:

Circle: nozzles that form the color image in the white former region and the white latter Region, Triangle: nozzles that are able to form the background image, Square: nozzles that are able to form the color image in the single region, (however, the color ink for performing the toning can be ejected in the white former region and the white latter region).

In this manner, it is possible to perform the printing of only the color image or the background image in the single region, and even when such a single region is provided between the white former region and the white latter region, it is possible to suitably switch over the printing from the white former region to the white latter region.

Other Embodiments

In the aforementioned embodiments, the nozzle row of the upstream side and the nozzle row of the downstream side in one head were described, but the number of heads is not limited to one. For example, the first head may be provided in the upstream side and the second head may be provided in the downstream side. Each head includes the nozzle row of the color ink and the white nozzle row. Even in this manner, it is possible to set the nozzle row of the color ink of the first head and the white nozzle row as the nozzle rows of the upstream side and set the nozzle row of the color ink of the second head and the white nozzle row as the nozzle rows of the downstream side.

In the aforementioned embodiments, the printer 1 was described as the printing apparatus, but the embodiments can also be embodied to a liquid ejecting apparatus that ejects or discharges other fluids (liquid, or liquid body in which particles of a functional material are dispersed, and fluidal body such as gel) than ink, without being limited thereto. For example, the same technique as the aforementioned embodiment may be applied to various apparatuses to which an ink jet technique is applied, such as a color filter manufacturing apparatus, a dyeing apparatus, a micro-fabricating apparatus, a semiconductor manufacturing apparatus, a surface finishing apparatus, a three-dimensional molding machine, a gas vaporizing apparatus, an organic EL manufacturing apparatus (especially, a polymer EL manufacturing apparatus), a display manufacturing apparatus, a film forming apparatus, and a DNA chip manufacturing apparatus. Furthermore, such methods or manufacturing methods are within the scope of application range.

The embodiments described above are to facilitate the understanding of the invention and are not for interpreting the invention in a limited manner. It is needless to say that the invention can be changed and improved without departing from the gist thereof and the equivalents thereof are included in the invention.

Head

In the embodiments mentioned above, ink was discharged by the use of a piezoelectric element. However, a method of discharging liquid is not limited thereto. For example, another method such as a method of generating bubbles in the nozzles by heat may be used.

What is claimed is:

1. A printing apparatus comprising:

a transport portion that transports a medium in a transport direction;

an upstream side background color nozzle that ejects a background color ink to the medium;

an upstream side color nozzle that ejects a color ink to the medium are aligned along the transport direction;

a downstream side background color nozzle that ejects the background color ink to the medium and is disposed in the downstream side further than the upstream side background color nozzle concerning the transport direction;

a downstream side color nozzle that ejects the color ink to the medium and is disposed in the downstream side further than the upstream side color nozzle concerning the transport direction;

a moving section that moves the upstream side background color nozzle, the upstream side color nozzle, the downstream side background color nozzle, and the downstream side color nozzle in an intersection direction intersecting the transport direction; and a control section that performs:

a background image pre-printing which enables each ink to be ejected from the upstream side background color nozzle and the downstream side color nozzle and can land the color ink after landing the background color ink on the medium, and a background image post-printing which enables each ink to be ejected from the upstream side color nozzle and the downstream side background color nozzle and can land the background color ink after landing the color ink on the medium, and wherein:

a single region forms any one of the background image and the color image; and the control section can perform the printing so as to switch over the single region forming and the background image pre-printing, and so as to switch over the single region forming and the background image post-printing.

2. The printing apparatus according to claim 1, wherein the upstream side background color nozzle, the downstream side background color nozzle, the upstream side color nozzle, and the downstream side color nozzle are integrally moved in the intersection direction.

3. The printing apparatus according to claim 1, wherein the ink is ejected in any one direction of a forward direction and a return direction during movement of the intersection direction.

4. The printing apparatus according to claim 1, wherein the background color ink is a white ink.

5. The printing apparatus according to claim 1, wherein the background color ink is ink of a metallic tone.

6. The printing apparatus according to claim 1, wherein the control section performs the toning of the background image by the use of the upstream side color nozzle in the background image pre-printing, and performs the toning of the background image by the use of the downstream side color nozzle in the background image post-printing.

7. A printing method using a printer which includes:

a transport portion that transports a medium in a transport direction;

an upstream side background color nozzle that ejects a background color ink to the medium;

an upstream side color nozzle that ejects a color ink to the medium are aligned along the transport direction;

a downstream side background color nozzle that ejects the background color ink to the medium and is disposed in the downstream side further than the upstream side background color nozzle concerning the transport direction;

a downstream side color nozzle that ejects the color ink to the medium and is disposed in the downstream side further than the upstream side color nozzle concerning the transport direction;

a moving section that moves the upstream side background color nozzle, the upstream side color nozzle, the downstream side background color nozzle, and the downstream side color nozzle in an intersection direction intersecting the transport direction; and a control section that performs:

a background image pre-printing which enables each ink to be ejected from the upstream side background color nozzle and the downstream side color nozzle and can land the color ink after landing the background color ink on the medium, and a background image post-printing which enables each ink to be ejected from the upstream side color nozzle and the downstream side background color nozzle and can land the background color ink after landing the color ink on the medium, wherein a single region forms any one of the background image and the color image; wherein the method comprises:

printing so as to switch over the single region forming and the background image pre-printing, or so as to switch over the single region forming and the background image post-printing.

* * * * *